United States Patent [19]

Rountree

[11] 4,177,846

[45] Dec. 11, 1979

[54] ROLL-UP PLACE MAT

[76] Inventor: Jean Rountree, 851 N. Michigan Ave., Pasadena, Calif. 91104

[21] Appl. No.: 951,639

[22] Filed: Oct. 16, 1978

[51] Int. Cl.[2] ..... A45F 5/04

[52] U.S. Cl. ..... 150/52 C; 24/7; 206/553

[58] Field of Search ..... 428/351–906; 2/48, 49 R, 49 A, 52; 150/52 C, 52 R; 220/DIG. 10; 206/541, 553, 812; 229/1.5 C; 224/5 T, 28 B, 26 E; 24/7; 248/346.1

[56] References Cited

U.S. PATENT DOCUMENTS

| | | | |
|---|---|---|---|
| 626,797 | 6/1899 | Shaw | 24/7 X |
| 1,587,387 | 6/1926 | Lichtman | 150/52 R |
| 1,679,101 | 7/1928 | Sternthal | 150/52 C |
| 2,652,702 | 9/1953 | Hintze | 206/541 X |
| 2,728,165 | 12/1955 | Runyon | 150/52 R |
| 3,376,974 | 4/1968 | Hilliard | 206/553 X |
| 3,429,718 | 2/1969 | Helms | 206/541 X |
| 3,978,553 | 9/1976 | Honig | 150/52 C |
| 4,125,903 | 11/1978 | Farrell | 5/343 X |
| 4,137,356 | 1/1979 | Shoemaker et al. | 428/178 X |

*Primary Examiner*—Henry F. Epstein
*Attorney, Agent, or Firm*—John Joseph Hall

[57] ABSTRACT

A roll-up place mat having a self-contained ring member for holding a napkin and a self-contained pocket member for holding dining flatware and capable of being rolled up and tied together while containing the napkin and flatware.

4 Claims, 4 Drawing Figures

ROLL-UP PLACE MAT

SUMMARY OF THE INVENTION

The invention comprises a roll-up place mat which provides a ring member for holding a napkin and a pocket member for holding dining flatware, and a ribbon sewn on the outside cover of the mat. After a napkin has been pulled through the ring member, and dining flatware inserted in the pocket member, the mat can be rolled up and the resulting rolled mat can be tied together with the ribbon. Thus, the roll-up place mat provides a convenient, portable, and efficient way of setting a table for guests.

It is, therefore, an object of my invention to provide a place mat having the capability of holding a napkin in place and holding dining flatware such as a knife, fork, and spoon, in place.

Another object of my invention is to provide a place mat which can be rolled up and tied while containing inside a napkin in place and dining flatware in place.

A further object of my invention is to provide a place mat which can be easily and quickly constructed from readily available materials.

These and other objects will be more readily understood by reference to the accompanying drawings, in which FIG. 1 is a perspective view of an embodiment of the invention showing the place mat in a flat position with the napkin in place and dining flatware in place.

Figure 1:
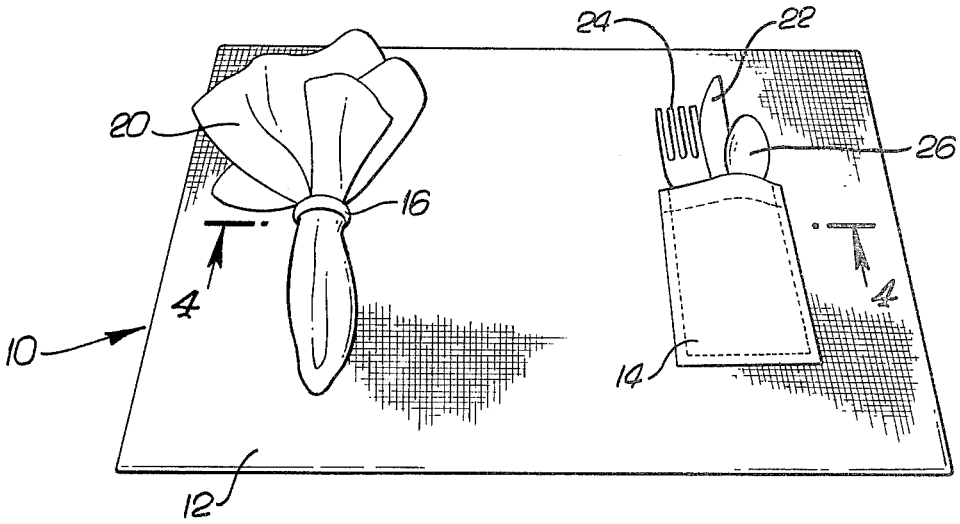
Figure 2:
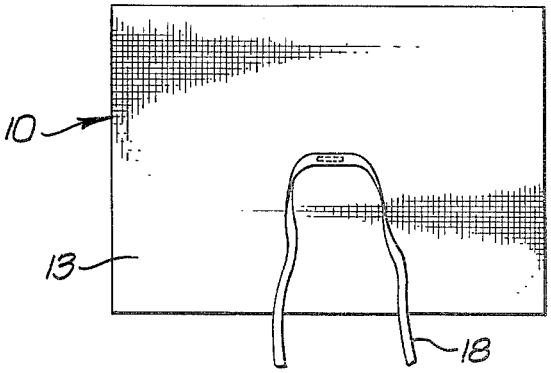
FIG. 2 is a plane view of the outer surface of the place mat in a flat position showing a ribbon attached thereto.
Figure 3:
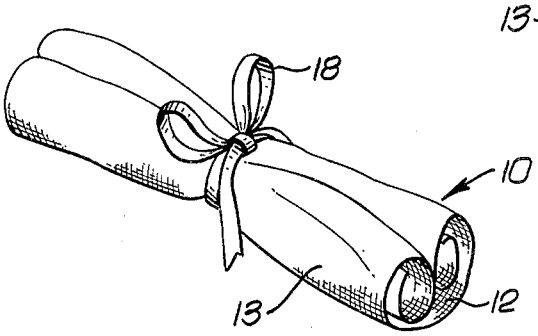
FIG. 3 is a view of the place mat rolled up and tied.
Figure 4:
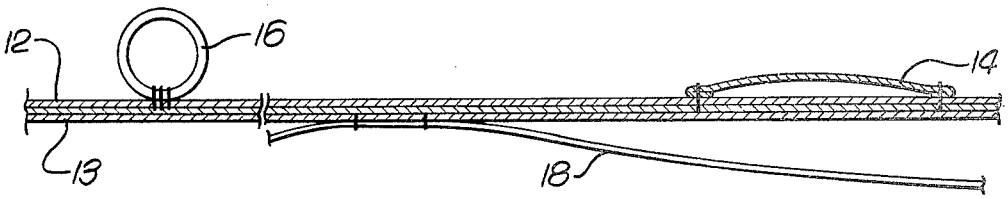
FIG. 4 is a section taken on line 4—4 of FIG. 1.

The roll-up place mat 10 is constructed using a rectangular sheet 12 of cloth or other suitable material, preferably print material about 20 by 14 inches in size. A pocket 14 is provided for the place mat 10 by cutting a rectangular piece of material to a size preferably of about 4 inches by 7 inches, and sewing the material on three sides at the lower right hand corner of the sheet 12, leaving a margin of about 3 inches at the right side, and 3 inches from the bottom of sheet 12.

A ring member 16, preferably made of plastic or other suitable material, is then sewn on or otherwise attached to sheet 12, preferably at a location of about 6 inches from the bottom and about 3 inches from the left side of sheet 12.

A lining sheet 13 having the same size as the rectangular print sheet 12 is cut from suitable lining material. A ribbon member 18, preferably about 24 inches long is sewn or otherwise attached to the center of lining sheet 13.

The right sides of print sheet 12 and lining sheet 13 are placed together and sewn together or otherwise attached at their respective edges on three sides. The corners are trimmed and then the resulting mat 10 is turned right side out. The open seams of mat 10 are sewn together or otherwise joined and the mat is ready for use.

In use, a napkin 20 is pulled through ring 16 and dining flatware such as a knife 22, fork 24, and spoon 26 are placed in the pocket 14. The mat is then rolled up and tied by means of a ribbon 18 and is ready for use.

Although I have described a preferred embodiment of my invention, it is understood that numerous changes in construction and arrangement of parts may be made within the scope of my invention as hereinafter claimed.

I claim:

1. A roll-up place mat having means for holding a napkin in place and dining flatware in place, while rolled up, comprising:

a flexible rectangular top sheet member having an attached pocket member to receive dining flatware, and an attached ring member to receive a napkin, said top sheet member being superimposed on a lining sheet member of equal size, said sheet member and said lining member having their respective edges connected together and wherein the outer surface of said lining member has an attached tying member to tie and maintain said roll-up place mat in a rolled up position while containing a napkin in place and dining flatware in place.

2. A roll-up place mat according to claim 1 in which said attached pocket member is located at the lower right-hand corner of said sheet member.

3. A roll-up place mat according to claim 1 in which said attached ring member is located at the lower left-hand corner of said sheet member.

4. A roll-up place mat according to claim 1 in which said attached pocket member is located at the lower right-hand corner of said sheet member and said attached ring member is located at the lower left-hand corner of said sheet member.

* * * * *